US006709367B1

(12) United States Patent
Liang

(10) Patent No.: US 6,709,367 B1
(45) Date of Patent: Mar. 23, 2004

(54) LEG EXERCISE MACHINE COMPRISING TWO FOOTRESTS CAPABLE OF HORIZONTAL AND VERTICAL MOTIONS AT THE SAME TIME

(76) Inventor: Hung-Min Liang, No. 5, Shui To Lane, Chia Hou Rd., Wai Pu Hsiang, Taichung Hsien (TW)

( * ) Notice: Subject to any disclaimer, the term of this patent is extended or adjusted under 35 U.S.C. 154(b) by 0 days.

(21) Appl. No.: 10/444,387

(22) Filed: May 27, 2003

(51) Int. Cl.[7] ..... A63B 22/04
(52) U.S. Cl. ..... 482/53; 482/52; 482/146
(58) Field of Search ..... 482/79, 80, 146, 482/147, 148, 51, 52, 53

(56) References Cited

U.S. PATENT DOCUMENTS 5,298,002 A * 3/1994 Lin ..... 482/53
5,453,065 A * 9/1995 Lien et al. ..... 482/52
5,545,111 A * 8/1996 Wang et al. ..... 482/53
5,628,709 A * 5/1997 Chen ..... 482/53
5,645,512 A * 7/1997 Yu ..... 482/53
5,800,313 A * 9/1998 Yu ..... 482/53
5,807,210 A * 9/1998 Devlin ..... 482/52
5,888,175 A * 3/1999 Chang ..... 482/53
6,102,833 A * 8/2000 Chen ..... 482/53
6,582,344 B2 * 6/2003 Tang ..... 482/53

* cited by examiner

*Primary Examiner*—Nicholas D. Lucchesi
*Assistant Examiner*—Tam M Nguyen
(74) *Attorney, Agent, or Firm*—Harrison & Egbert

(57) ABSTRACT

A leg exercise machine includes a base and a swivel mechanism by which two footrests are mounted on the base. The swivel mechanism has an upright post mounted on the base, a horizontal shaft fastened pivotally at one end to the upright post, a horizontal support tube rotatably fitted over the horizontal shaft and provided at one end with a connection bar, and a link rod connected at one end with the connection bar of the horizontal support tube by a first universal joint, with the other end of the link rod being connected to the base in conjunction with a second universal joint. The two footrests are supported respectively by a tilted arm on the horizontal support tube such that the two footrests are capable of vertical and horizontal motions at the same time.

4 Claims, 7 Drawing Sheets

LEG EXERCISE MACHINE COMPRISING TWO FOOTRESTS CAPABLE OF HORIZONTAL AND VERTICAL MOTIONS AT THE SAME TIME

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a leg exercise machine, and more particularly to a swivel mechanism enabling the footrests of the leg exercise machine to swivel horizontally and vertically at the same time.

BACKGROUND OF THE INVENTION

The conventional leg exercise machine comprises two footrests capable of moving up and down. In operation, the feet of an exerciser are supported on the footrests. As one of the two footrests is forced to move downwards, other one of the two footrests is caused to move upwards. Such a mechanism of the conventional leg exercise machine is similar in nature to that of a seesaw. However, the footrests of the conventional leg exercise machine are limited in design in that they are incapable of moving vertically and horizontally at the same time.

BRIEF SUMMARY OF THE INVENTION

The primary objective of the present invention is to provide a leg exercise machine with a mechanism enabling two footrests of the leg exercise machine to swivel vertically and horizontally at the same time.

The leg exercise machine of the present invention comprises a base and a swivel mechanism by which two footrests are mounted on the base. The swivel mechanism comprises a horizontal support tube, a horizontal shaft, a first universal joint, a second universal joint, and a link rod. The two footrests are oppositely mounted on the horizontal support tube which is fitted rotatably over the horizontal shaft. The horizontal support tube is connected at one end with one end of the link rod by the first universal joint. The link rod is connected at other end with the base by the second universal joint. As one of the two footrests is forced to move down, other one of the two footrests moves up. In the meantime, the horizontal support tube is caused to swivel horizontally, thereby causing the footrests to swivel likewise.

The features and the advantages of the present invention will be more readily understood upon a thoughtful deliberation of the following detailed description of the preferred embodiments of the present invention with reference to the accompanying drawings.

DETAILED DESCRIPTION OF THE INVENTION

Figure 1:
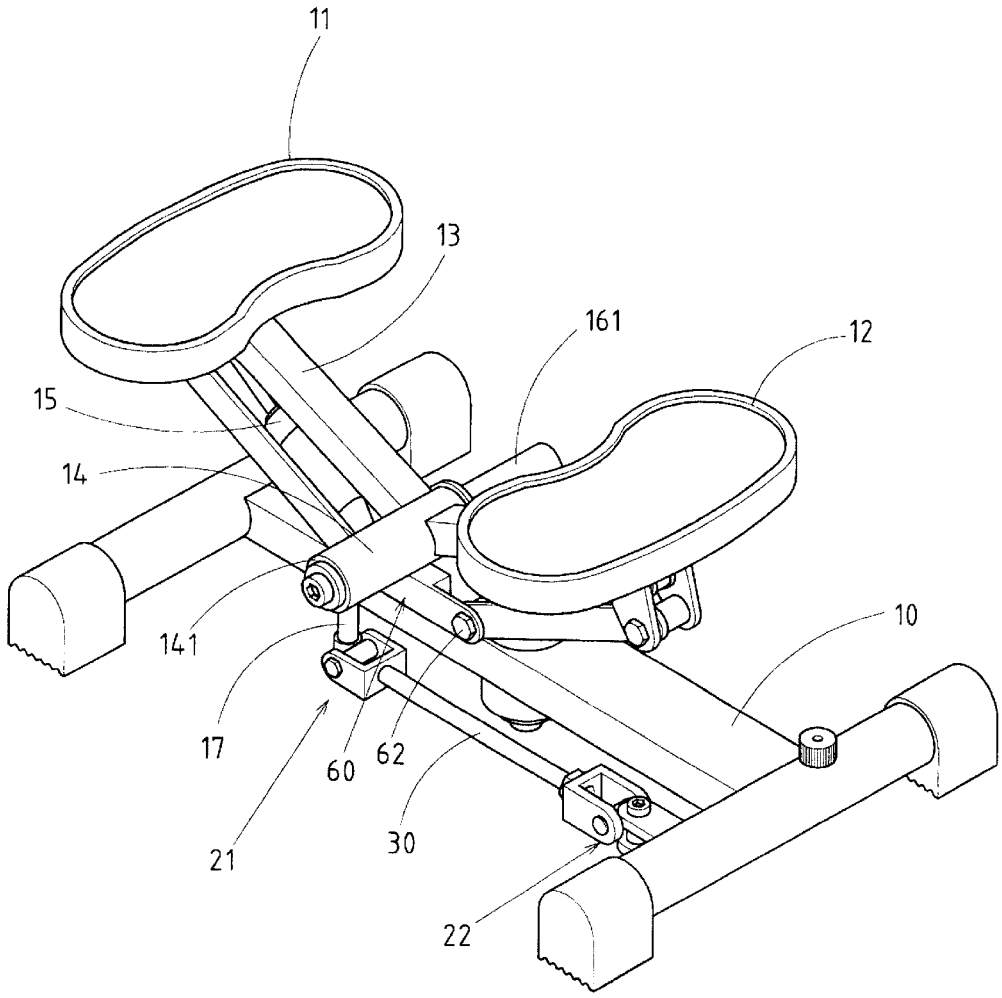
FIG. 1 shows a perspective view of a first preferred embodiment of the present invention.

As shown in FIGS. 1–4, a leg exercise machine embodied in the present invention comprises a base 10 on which a first footrest 11 and a second footrest 12 are oppositely mounted by two tilted arms 13 in conjunction with a swivel mechanism.

The swivel mechanism comprises a horizontal support tube 14, an upright post 16, a horizontal shaft 161, a first universal joint 21, a second universal joint 22, and a link rod 30. The upright post 16 is rotatably mounted at a bottom end on the base 10. The horizontal shaft 161 is pivotally fastened at one end with a top end of the upright post 16 such that the horizontal shaft 161 and the upright post 16 form a right angle. The horizontal support tube 14 is rotatably fitted over the horizontal shaft 161. The two tilted arms 13 are fastened oppositely at a lower end with the horizontal support tube 14, with the upper ends of the two tilted arms 13 supporting respectively the first footrest 11 and the second footrest 12. As a result, when the two footrests 11 and 12 are caused to move up and down, the horizontal support tube 14 turns on the horizontal shaft 161. The horizontal support tube 14 is provided at an outer end 141 with a connection bar 17 extending therefrom such that the connection bar 17 is perpendicular to the longitudinal axis of the horizontal support tube 14. The outer end 141 of the horizontal support tube 14 is connected by the connection bar 17 to one end of the link rod 30 in conjunction with the first universal joint 21. The link rod 30 is fastened at other end with a fastening piece 18 of the base 10 in conjunction with the second universal joint 22. It must be noted here that the two footrests 11 and 12 are supported by the horizontal support tube 14 in conjunction with the two tilted arms 13 and two damping devices 15 by which the exercise effect of the machine is enhanced.

Figure 5:
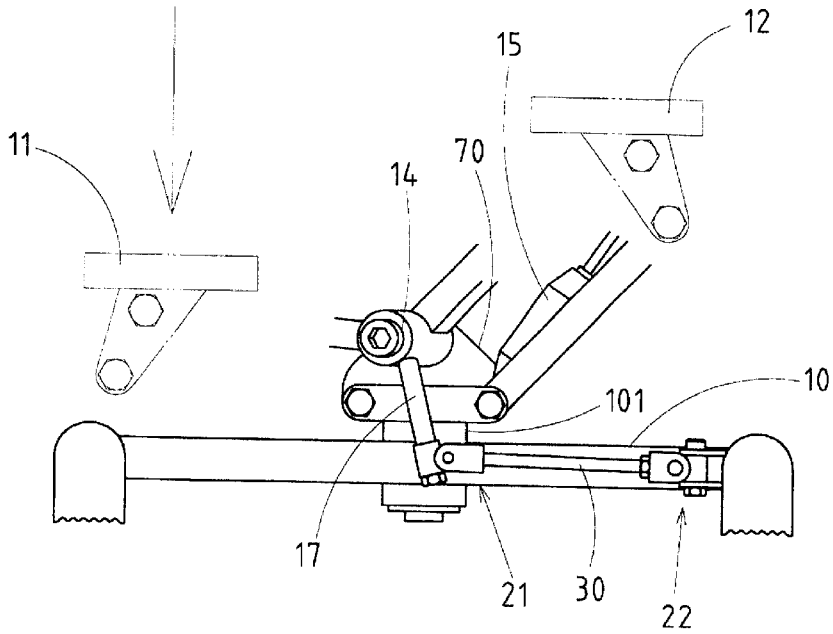
FIG. 5 shows a first side schematic view of the first preferred embodiment of the present invention in action.
Figure 6:
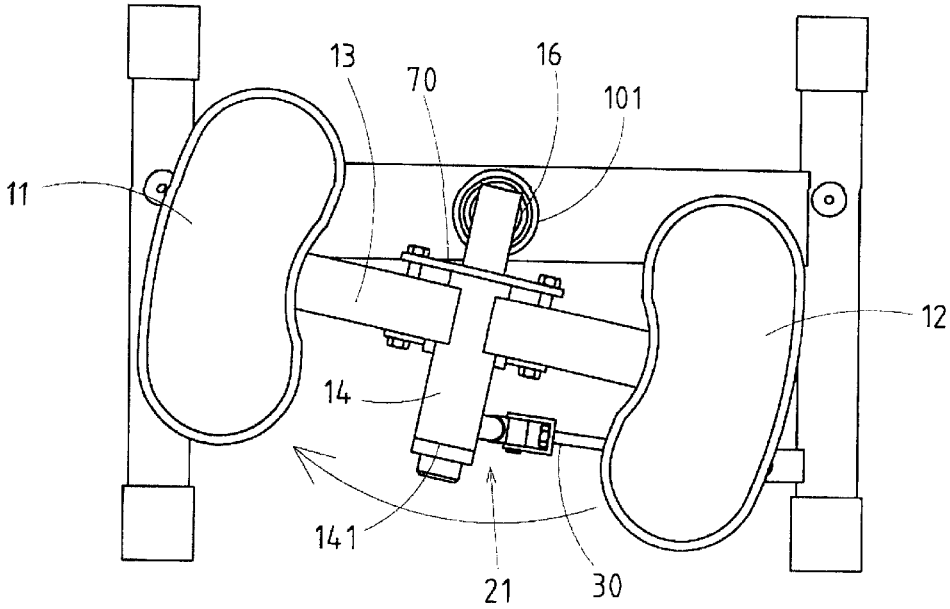
FIG. 6 shows a first top schematic view of the first preferred embodiment of the present invention in action.
Figure 7:
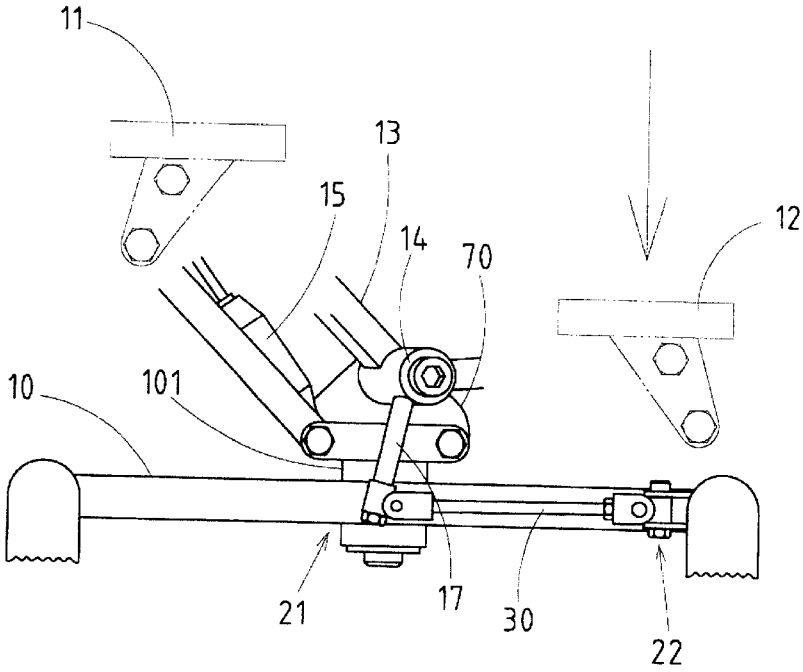
FIG. 7 shows a second side schematic view of the first preferred embodiment of the present invention in action.
Figure 8:
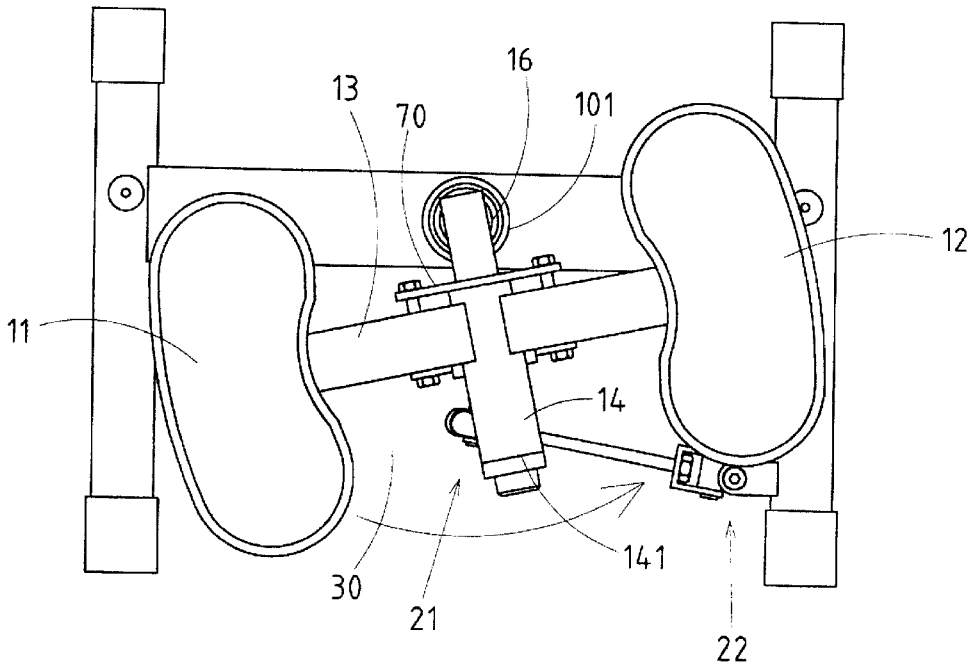
FIG. 8 shows a second top schematic view of the first preferred embodiment of the present invention in action.

As illustrated in FIGS. 5 and 6, the first footrest 11 is exerted on by an external force to move downward, the horizontal support tube 14 is thus actuated to turn on the horizontal shaft 161, thereby causing the second footrest 12 to move upward. In the meantime, the reaction force of the link rod 30 causes the horizontal support tube 14 and the horizontal shaft 161 to swivel clockwise. Similarly, when the second footrest 12 is exerted on by an external force to move downward, as shown in FIG. 7, the horizontal support tube 14 is actuated to turn on the horizontal shaft 161, thereby causing the first footrest 11 to move upward. In the meantime, the horizontal support tube 14 and the horizontal shaft 161 are caused to swivel counterclockwise, as shown in FIG. 8. In light of the horizontal support tube 14 being fitted over the horizontal shaft 161 which is pivotally fastened at one end thereof with a top end of the upright post

16, the horizontal support tube 14 and the horizontal shaft 161 can swivel together.

It must be noted here that the link rod 30 and the horizontal support tube 14 are preferably arranged in such a manner that the longitudinal axes of the link rod 30 and the horizontal support tube 14 form an angle of 90 degrees.

Figure 2:
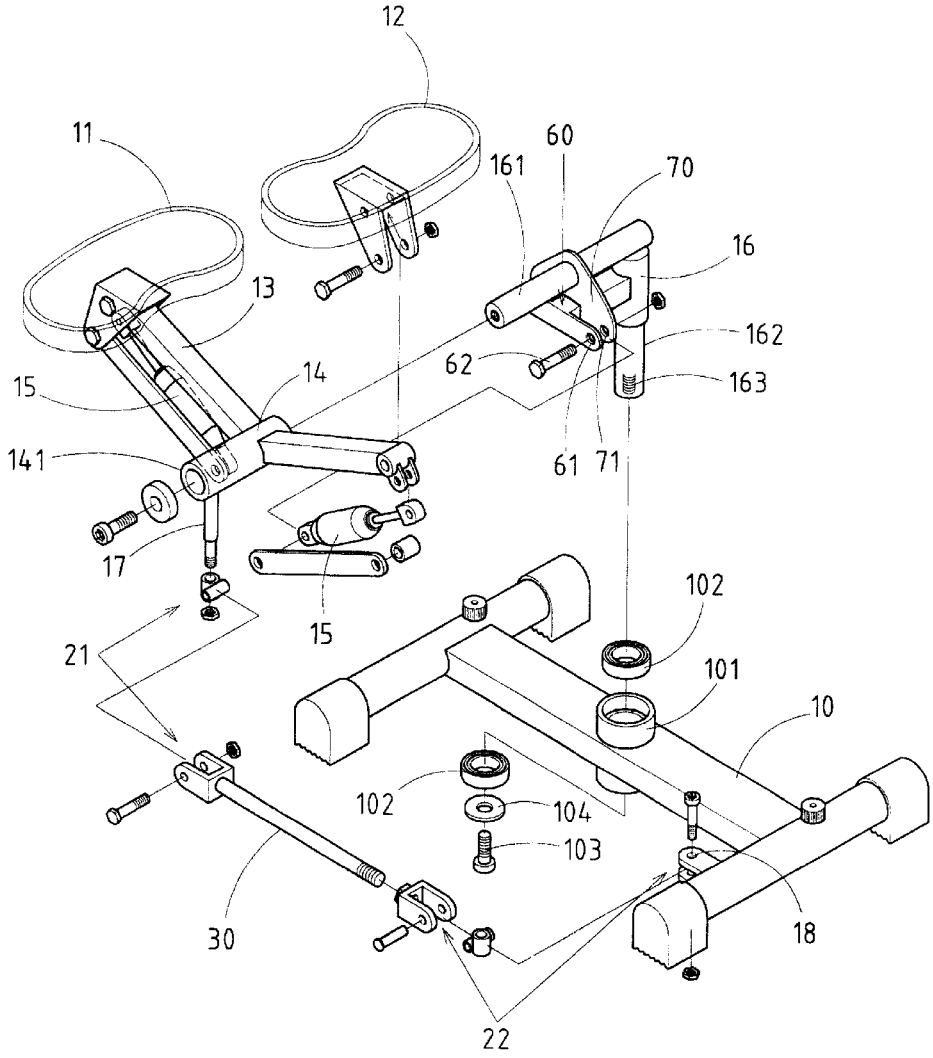
FIG. 2 shows an exploded perspective view of the first preferred embodiment of the present invention.
Figure 3:
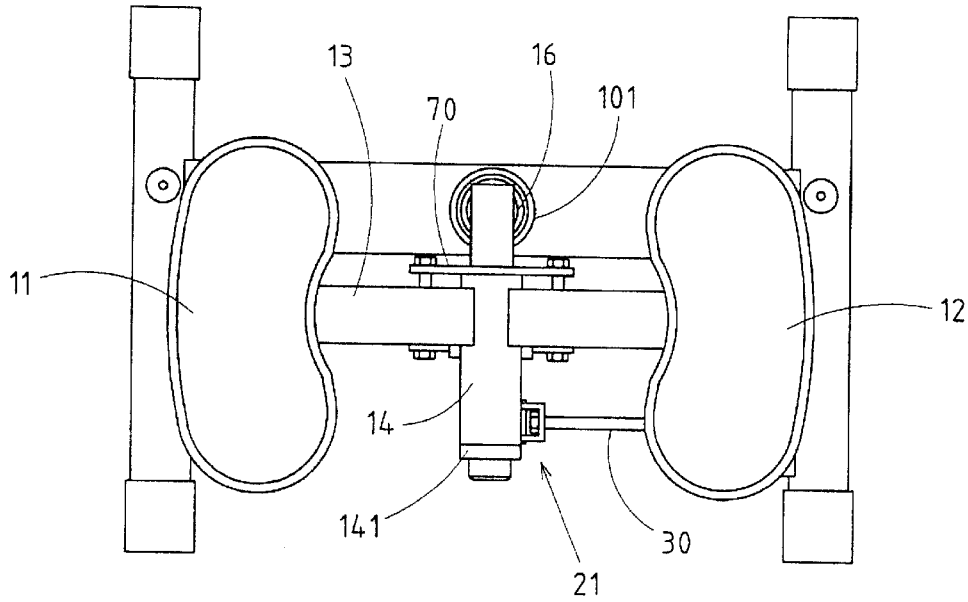
FIG. 3 shows a top plan view of the first preferred embodiment of the present invention.
Figure 4:
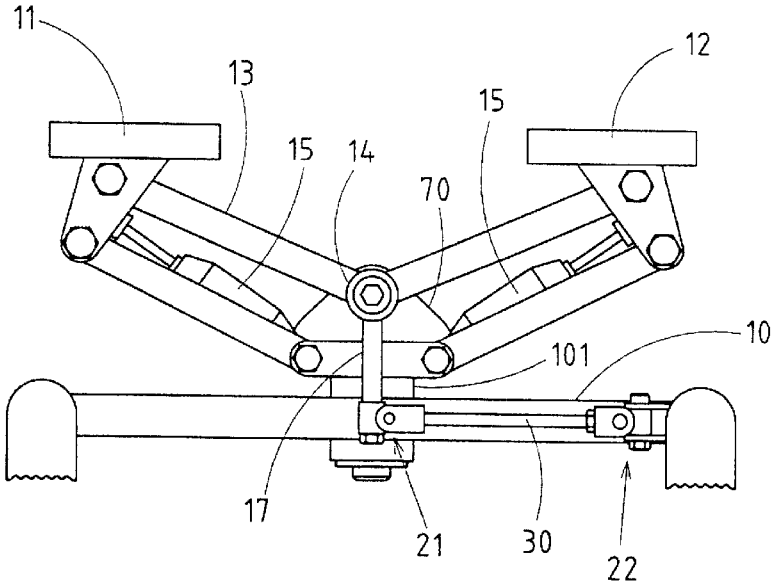
FIG. 4 shows a side view of the first preferred embodiment of the present invention.

As shown in FIG. 2, the upright post 16 is provided at the bottom end with a threaded hole 163. The base 10 is provided in an upper side with a mounting seat 101 in which a bearing 102 is located. The upright post 16 is mounted uprightly on the base 10 such that a lower segment 162 of the upright post 16 is inserted into the bearing 102, and that a bolt 103 is engaged with the threaded hole 163 of the bottom end of the upright post 16. The bolt 103 is fastened into the bottom end of the upright post 16 from the underside of the mounting seat 101 in conjunction with a washer 104.

As shown in FIG. 2, the horizontal shaft 161 is provided with a support structure comprising a support frame 60 and a reinforcing member 70. The horizontal shaft 161 is disposed between the support frame 60 and the reinforcing member 70. In addition, the support frame 60 is provided with a through hole 61, while the reinforcing member 70 is provided with a through hole 71 corresponding in location to the through hole 61 of the support frame 60. The support frame 60 and the reinforcing member 70 are fastened with one end of one of the two damping devices 15 by a fastening bolt 62 which is put through the through holes 61 and 71.

Figure 9:
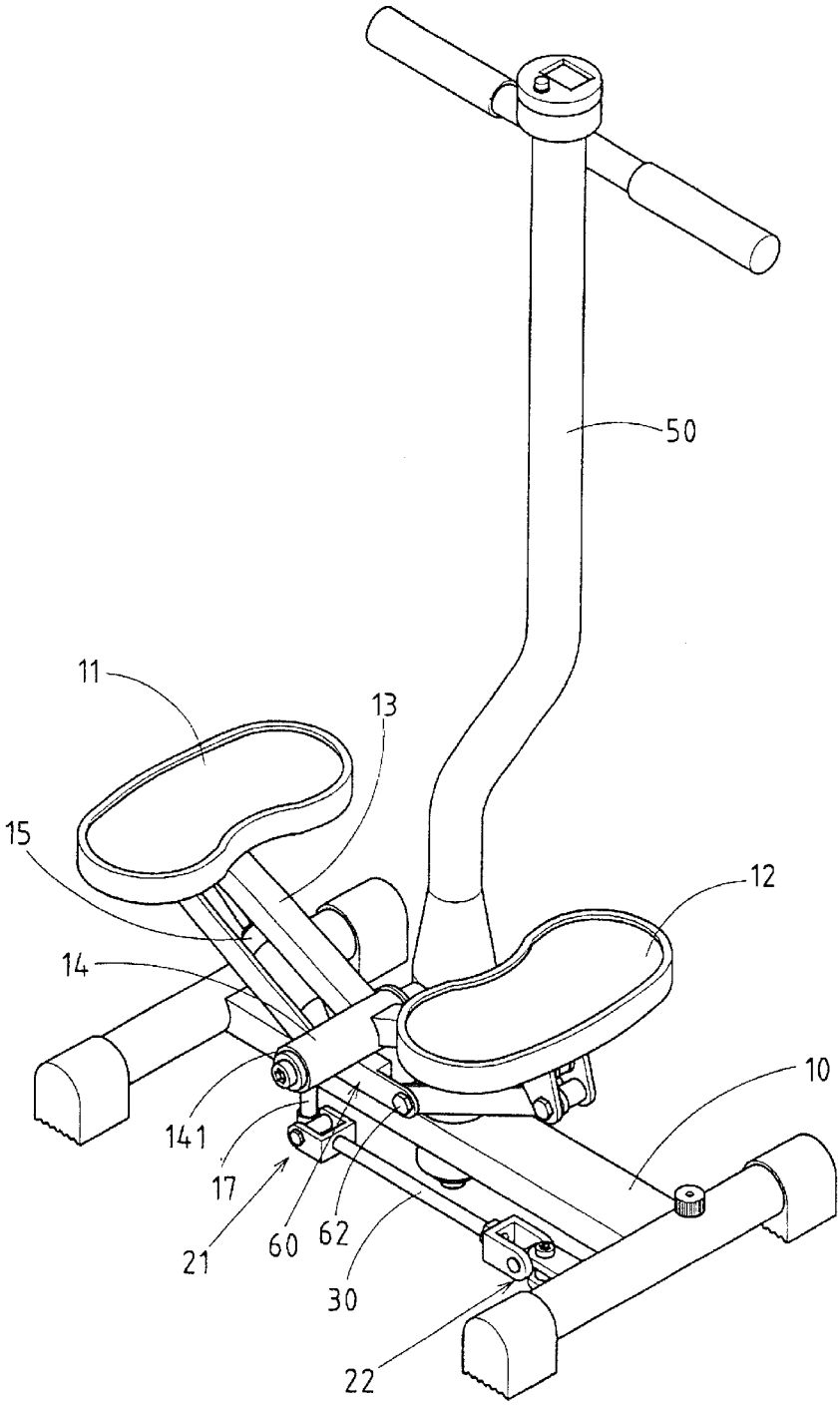
FIG. 9 shows a perspective view of a second preferred embodiment of the present invention.
Figure 10:
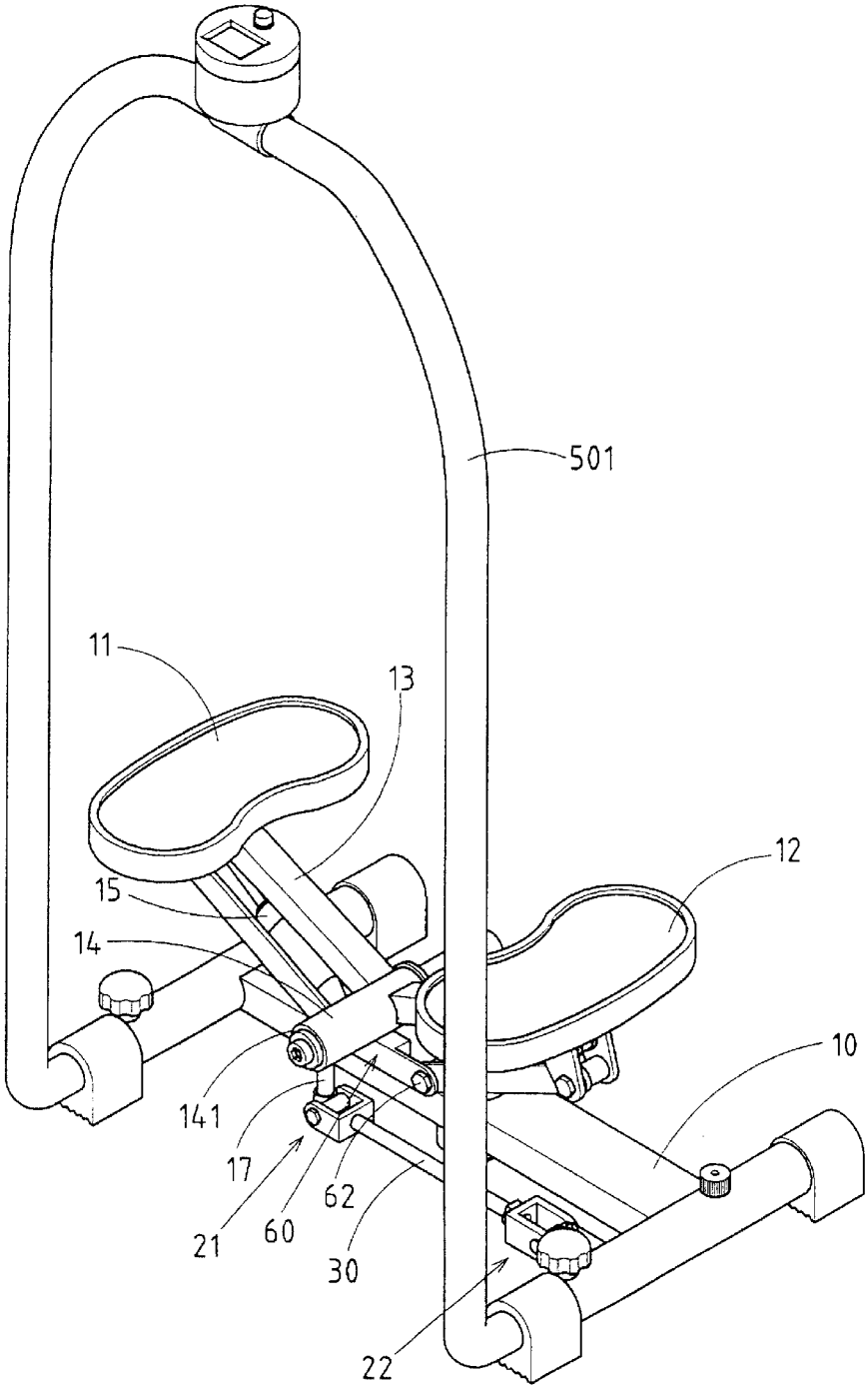
FIG. 10 shows a perspective view of a third preferred embodiment of the present invention.

The machine of the present invention further comprises a handle 50 which is mounted on the swivel mechanism, as shown in FIG. 9, or a handle 501 which is mounted on the base 10, as shown in FIG. 10.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A leg exercise machine comprising:

a base;

a swivel mechanism mounted on said base; and two footrests mounted respectively on said swivel mechanism in conjunction with a tilted arm and a damping device;

wherein said swivel mechanism comprises:

an upright post mounted uprightly on said base:

a horizontal shaft fastened pivotally at one end of said shaft to a top end of said upright post;

a horizontal support tube rotatably fitted over said horizontal shaft and fastened to one end of said tilted arm wherein the horizontal support tube is provided at one end with a connection bar extending therefrom; and a link rod fastened at one end to said connection bar by a first universal joint, said link rod is further fastened at an opposite end to said base by a second universal joint.

2. The leg exercise machine as defined in claim 1, wherein said horizontal support tube and said link rod are arranged in such a manner that a longitudinal axis of said horizontal support tube and a longitudinal axis of said link rod form an angle of 90 degrees.

3. The leg exercise machine as defined in claim 1, wherein said upright post is mounted at a bottom end thereof in a mounting seat of said base in conjunction with a bearing and a fastening bolt.

4. The leg exercise machine as defined in claim 1, wherein said horizontal shaft is comprised of a support structure.

* * * * *